US006289951B1

(12) United States Patent
Chiang

(10) Patent No.: US 6,289,951 B1
(45) Date of Patent: Sep. 18, 2001

(54) WOOD PLANING MACHINE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 09/709,940

(22) Filed: Nov. 9, 2000

(51) Int. Cl.[7] ..... B27C 1/00

(52) U.S. Cl. ..... 144/130; 144/117.1; 403/109.5; 403/110; 403/374.5

(58) Field of Search ..... 144/114.1, 117.1, 144/129, 130; 403/109.1, 109.5, 192, 372, 374.2, 374.5, 110

(56) References Cited

U.S. PATENT DOCUMENTS 5,013,177 * 5/1991 Sol ..... 403/374.5 X
5,771,949 6/1998 Welsh et al. ..... 144/130
5,829,499 * 11/1998 Liao ..... 144/130
5,967,205 * 10/1999 Welsh et al. ..... 144/117.1
6,085,812 * 7/2000 Chaing ..... 144/117.1
6,089,286 * 7/2000 Liao ..... 144/130 X
6,142,699 * 11/2000 Pao ..... 403/109.5

* cited by examiner

*Primary Examiner*—W Donald Bray
(74) *Attorney, Agent, or Firm*—Christie, Parker & Hale, LLP

(57) ABSTRACT

A wood planing machine includes a base with posts, a cutter carriage, and a locking unit including clamp members pivoted on the cutter carriage and turnable toward the posts, linkage members that respectively extend between two adjacent ones of the clamp members and that have rear ends that engage one of two adjacent ones of the clamp members, and actuating members, each having a pivot end pivoted on the front end of one of the linkage members for turning relative thereto and formed with a cam face which is eccentric relative to a center of rotation of the actuating member, and which engages the other one of the two adjacent clamp members in a cam action manner.

11 Claims, 8 Drawing Sheets

WOOD PLANING MACHINE

BACKGROUND OF THE INVENTION

1. Field of the Invention

This invention relates to a wood planing machine, more particularly to a wood planing machine having a carriage locking unit for positioning a cutter carriage on the wood planing machine.

2. Description of the Related Art

FIGS. 1 to 3 illustrate a conventional wood planing machine 10 that is disclosed in U.S. Pat. No. 5,771,949. The wood planing machine 10 includes a base 11 with two pairs of upstanding posts 12 disposed at the corners of the base 11 for supporting a cutter carriage 13 thereon, a height adjusting unit (not shown) for adjusting height of the cutter carriage 13 relative to the base 11 via a handle 16 which is mounted on a top end of the wood planing machine 10, and a carriage locking mechanism 20 for positioning the cutter carriage 13 on the posts 12. The cutter carriage 13 confines with the base 11 a wood passageway therebetween for passage of a workpiece 17. The carriage locking mechanism 20 includes a locking handle 21, two pairs of cooperating first and second locking linkages 221, 222 (only one pair is shown) pivoted on the locking handle 21 and associated with the pairs of the posts 12, and a plurality of post clamps 23 respectively associated with the posts 12. The post clamps 23 are resiliently deflectable, and engage their associated posts 12 to prevent vertical translation of the cutter carriage 13. The second locking linkage 222 includes first and second members (not shown), which are telescopically related. A coiled spring 223 is disposed in the second locking linkage 222, and is captured by the first and second members. The first and second locking linkages 221, 222 are turnable relative to each other via operation of the locking handle 21 between a clamped position, in which the first and second locking linkages 221, 222 are aligned (see FIG. 3), and the coiled spring 223 urges the post clamps 23 via the first and second locking linkages 221, 222 to provide clamping forces onto the posts 12, and a release position, in which the first and second locking linkages 221, 222 form an angle (see FIG. 2), and clamping surfaces of the post clamps 23 are in loose contact with the posts 12, thereby permitting vertical translation of the cutter carriage 13.

The wood planing machine 10 is disadvantageous in that it is relatively complex to assemble the carriage locking mechanism 20. Moreover, there is a tendency for the coiled spring 223 to experience elastic fatigue after being in use for a period of time, and can cause undesirable problems, such as loosening and vibration of the cutter carriage 13 during operation of the wood planing machine 10.

SUMMARY OF THE INVENTION

Therefore, it is an object of the present invention to provide a wood planing machine that is capable of overcoming the disadvantages described above.

Accordingly, a wood planing machine of this invention comprises: a base having a plurality of spaced apart posts that extend upright therefrom; a cutter carriage mounted movably on the posts; and a carriage locking unit including a plurality of clamp members pivoted on the cutter carriage and turnable respectively toward the posts, a plurality of linkage members, each of which extends between two adjacent ones of the clamp members, and each of which has a front end and a rear end that engages one of two adjacent ones of the clamp members, and a plurality of actuating members, each of which has a pivot end pivoted on the front end of one of the linkage members for turning relative thereto, the pivot end having a cam face that is eccentric relative to a center of rotation of the actuating member, and engaging the other one of the two adjacent clamp members in a cam action manner, each of the actuating members being turnable relative to the respective one of the linkage members between a clamped position, in which the two adjacent clamp members are respectively pushed by the rear end of the respective one of the linkage members and the respective one of the actuating members, thereby providing a clamping force onto the posts and thus preventing movement of the cutter carriage along the posts, and a release position, in which the two adjacent clamp members are released from the rear end of the respective one of the linkage members and the respective one of the actuating members to turn away from the posts, thereby permitting the movement of the cutter carriage along the posts.

BRIEF DESCRIPTION OF THE DRAWINGS

In drawings which illustrate an embodiment of the invention.

DETAILED DESCRIPTION OF THE PREFERRED EMBODIMENT

Figure 1:
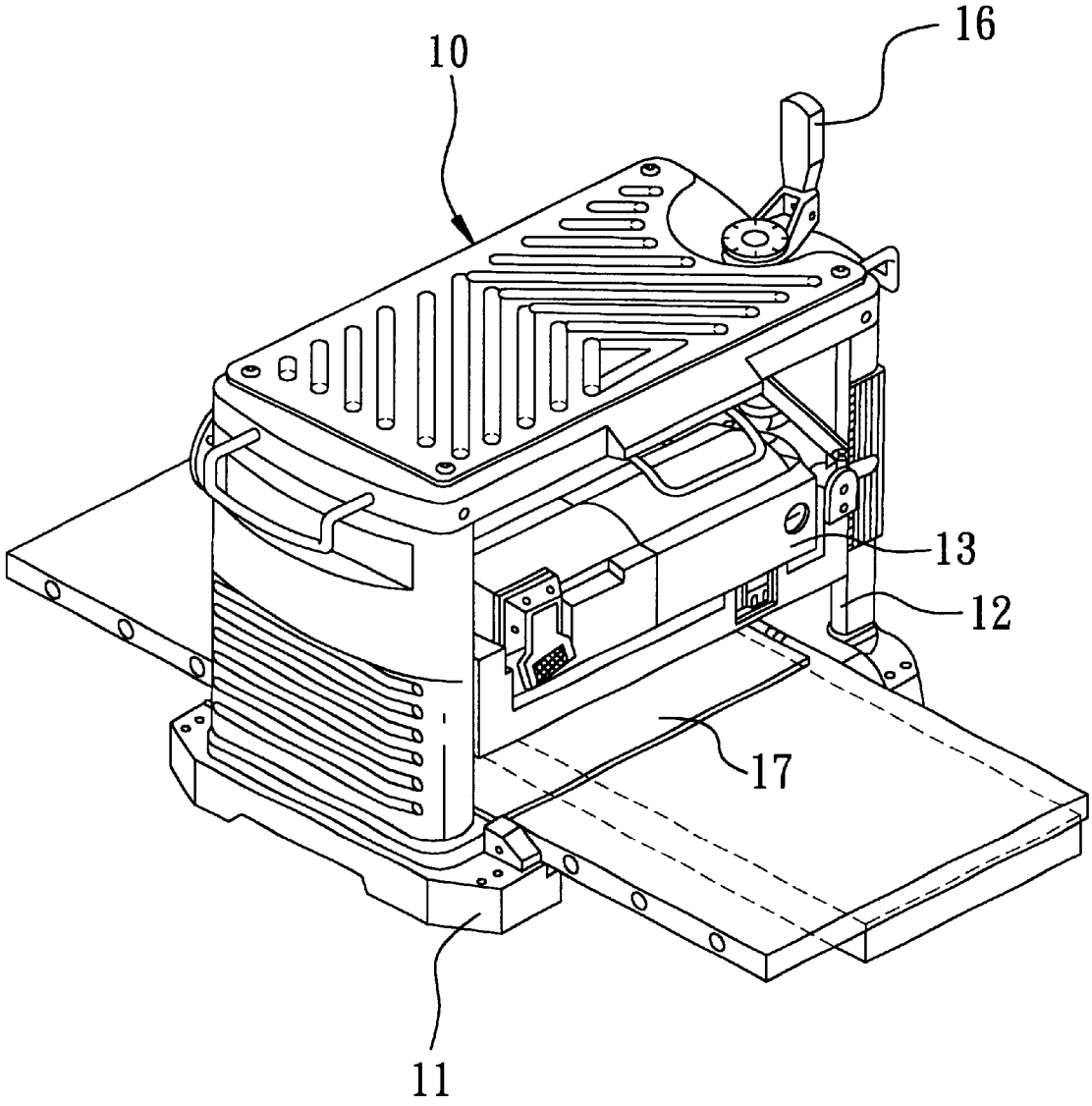
FIG. 1 PRIOR ART
FIG. 1 is a perspective view of a conventional wood planing machine.
Figure 2:
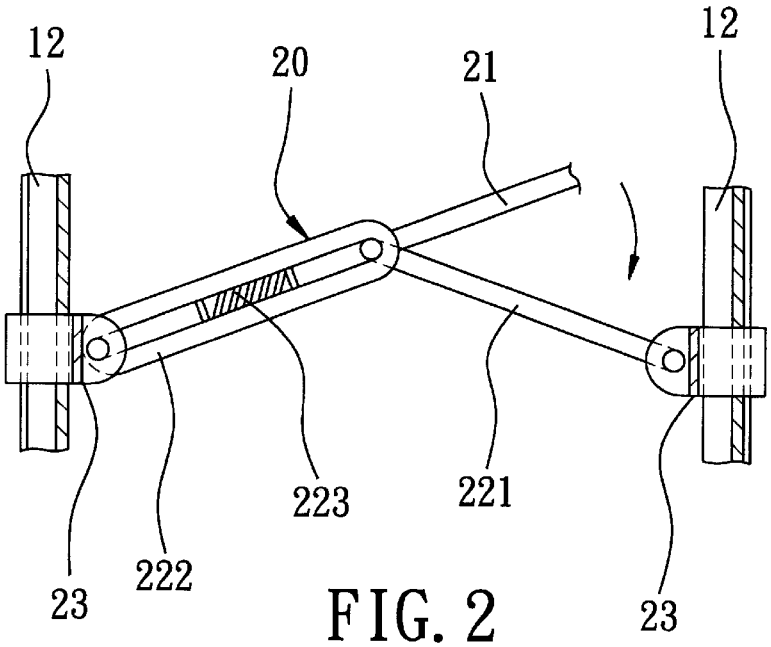
FIG. 2 PRIOR ART
FIG. 2 is a fragmentary cross-sectional side view of a carriage locking mechanism of the wood planing machine of FIG. 1 in a release position.
Figure 3:
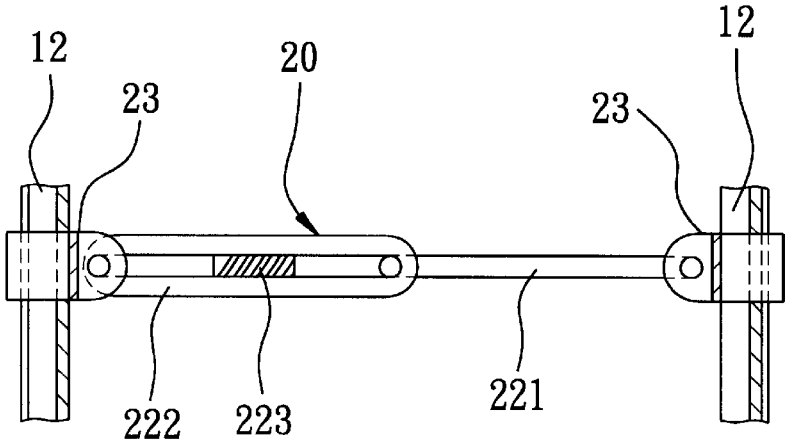
FIG. 3 PRIOR ART
FIG. 3 is a fragmentary cross-sectional side view of the carriage locking mechanism of the wood planing machine of FIG. 1 in a clamped position.
Figure 4:
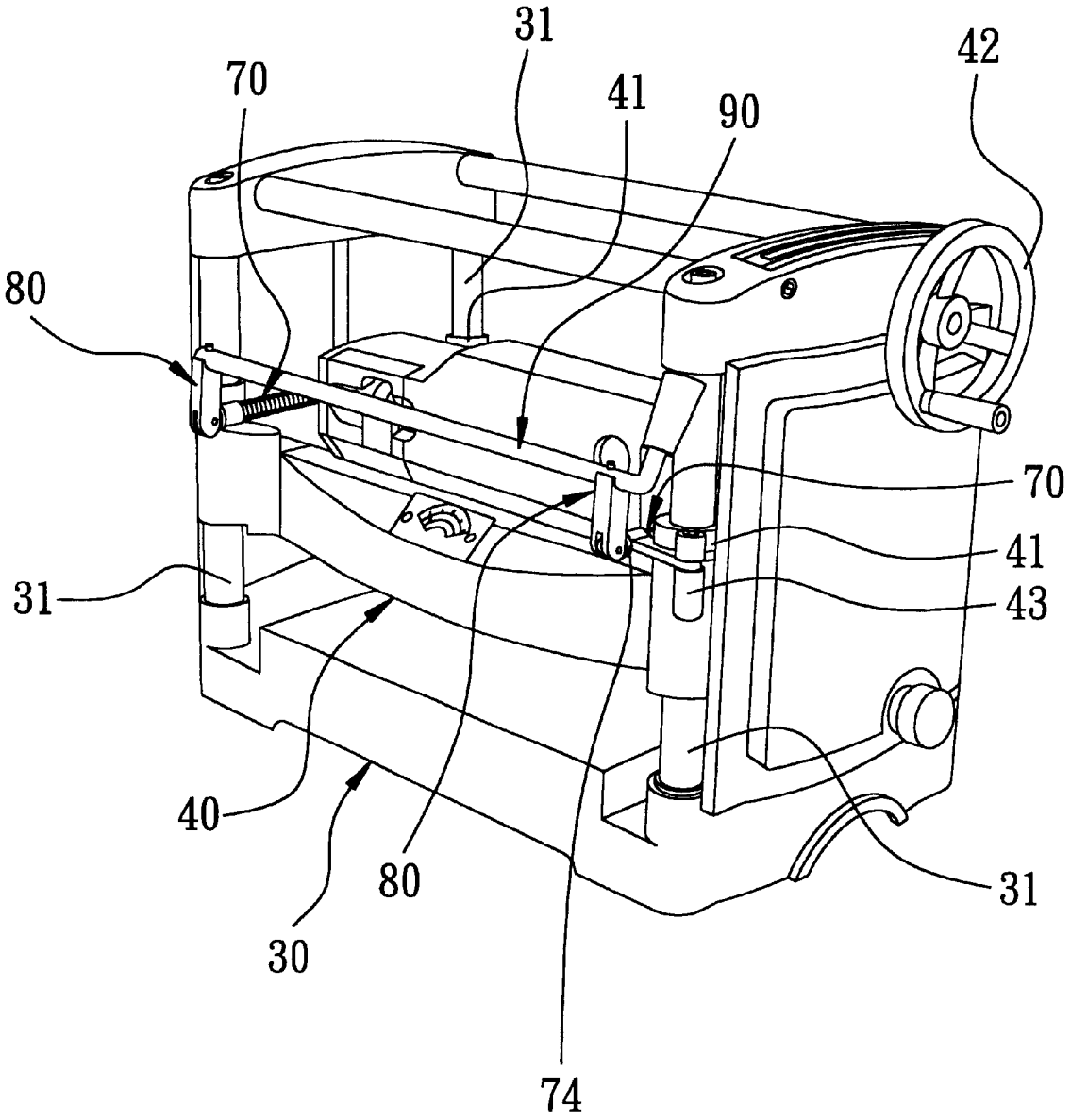
FIG. 4 is a perspective view of a wood planing machine embodying this invention.
Figure 5:
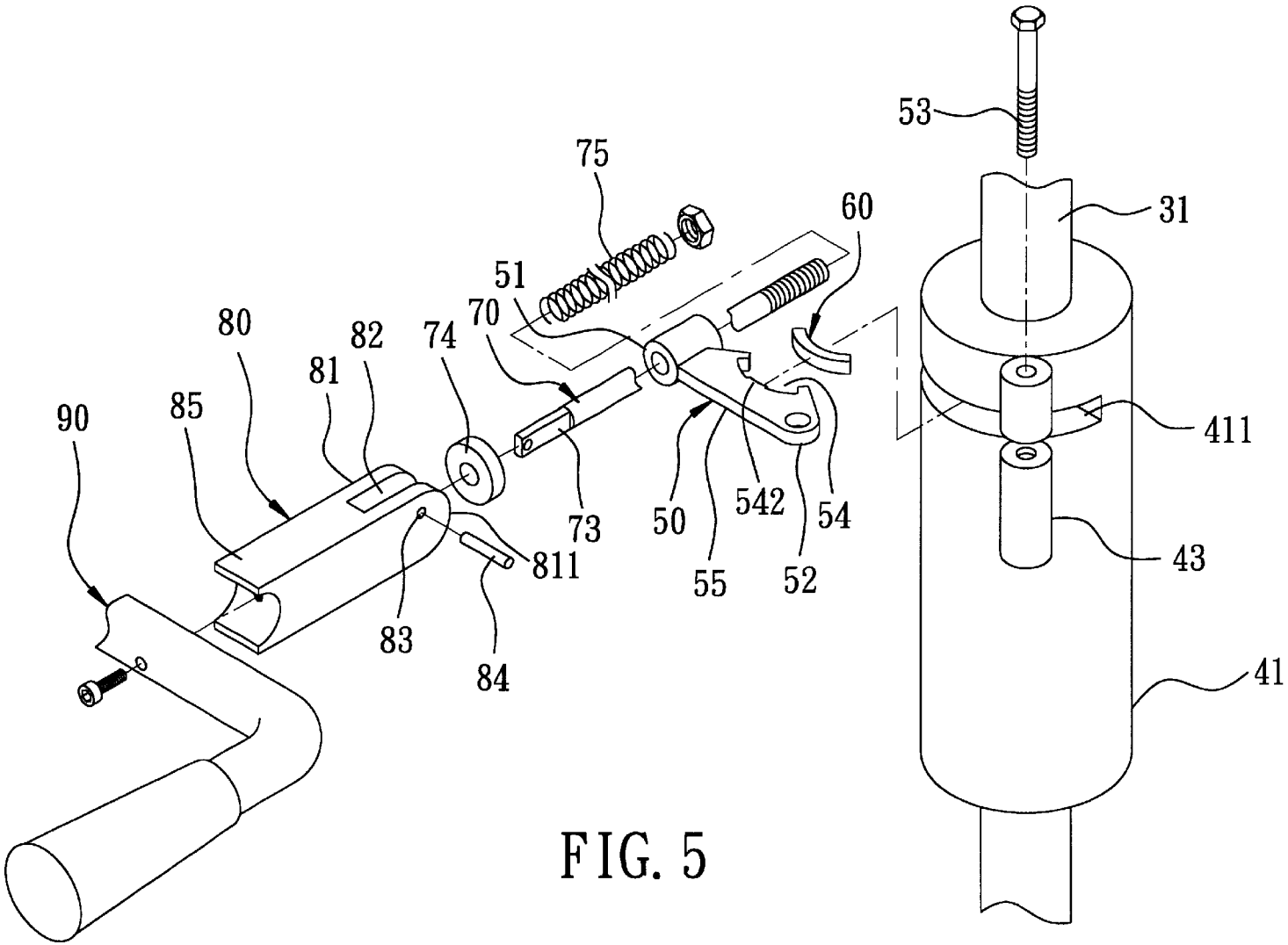
FIG. 5 is a fragmentary exploded view of a carriage locking unit of the wood planing machine of FIG. 4.
Figure 6:
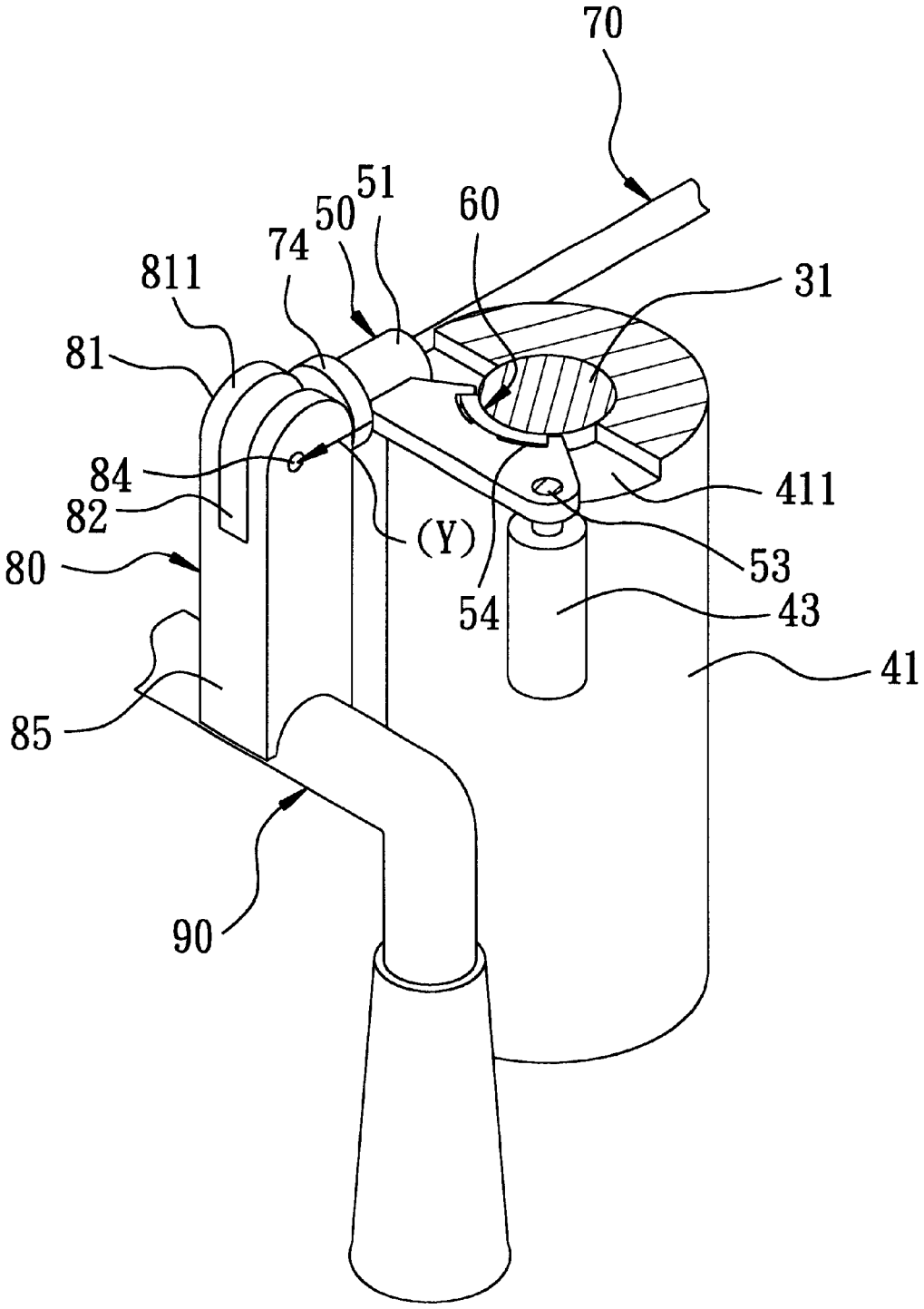
FIG. 6 is a fragmentary perspective view of the carriage locking unit of the wood planing machine of FIG. 4 in a clamped position.
Figure 7:
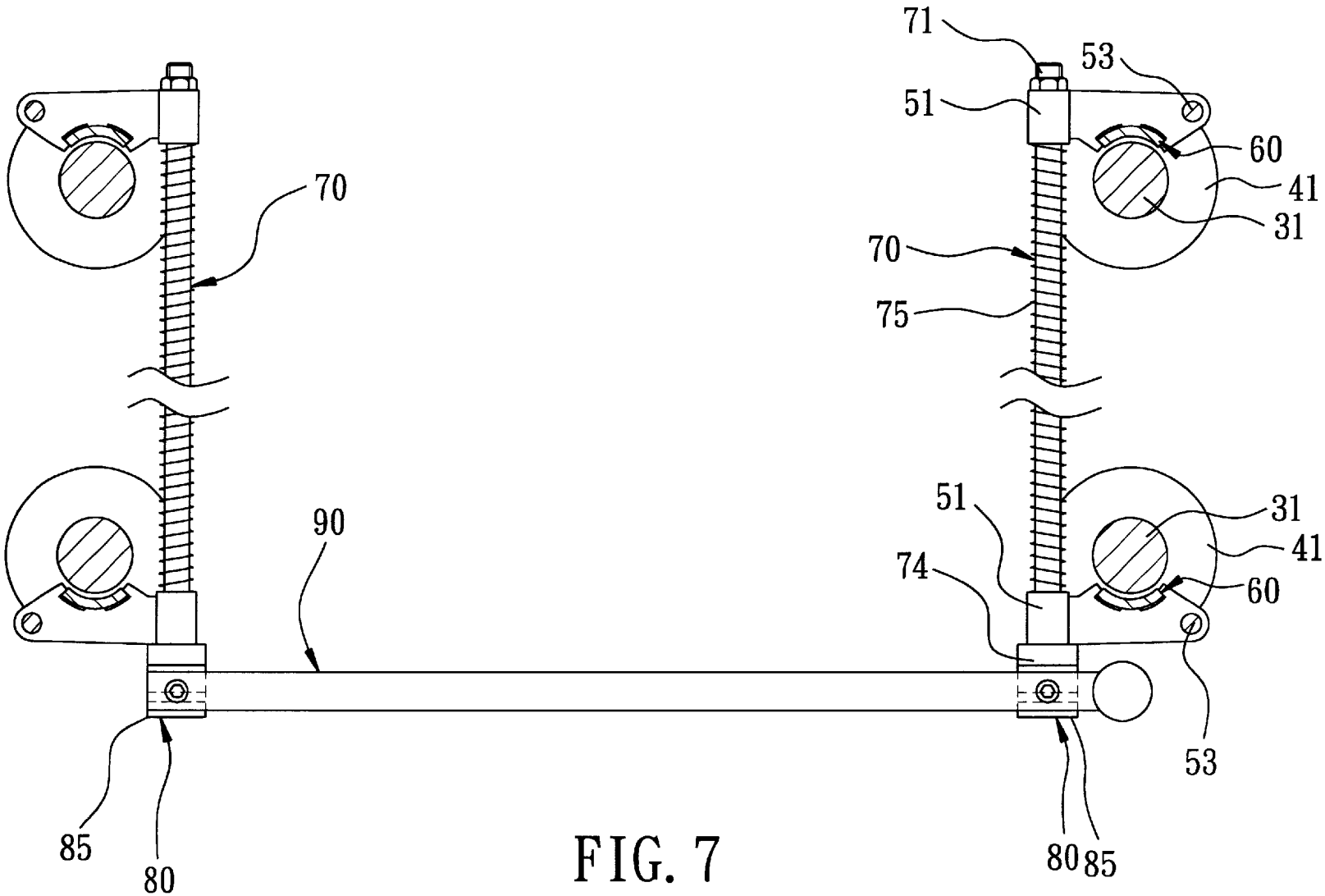
FIG. 7 is a fragmentary cross-sectional top view of the carriage locking unit of the wood planing machine of FIG. 4 in a release position.

FIGS. 4 to 7 illustrate a wood planing machine embodying this invention. The wood planing machine includes a base 30, four posts 31 raising uprightly from four corners of the base 30, a cutter carriage 40 mounted movably on the posts 31, a motor-driven rotary cutter (not shown) mounted on the cutter carriage 40, a height adjusting unit (not shown) provided with a handle-wheel 42 for adjusting height of the cutter carriage 40, and a carriage locking unit mounted on the cutter carriage 40 for preventing vertical translation of the cutter carriage 40 relative to the posts 31.

The cutter carriage 40 includes four sleeves 41 respectively sleeved around the posts 31 and having slots 411 that respectively extend radially and inwardly to the posts 31. An axially extending hinge 43 is provided on each sleeve 41 adjacent to the respective slot 411.

The carriage locking unit includes four clamp members 50 respectively associated with the posts 31, two linkage members 70 each associated with two adjacent ones of the clamp members 50, two annular engaging members 74 each associated with one of the linkage members 70, two actuating members 80 each associated with one of the engaging members 74 and one of the linkage members 70, and a handle 90 interconnecting the actuating members 80.

Each clamp member 50 has a pivot end 52 pivoted on the sleeve 41 on the respective post 31 via a pivot bolt 53 passing through the pivot end 52 and the hinge 43 on the sleeve 41 for turning about the pivot bolt 53 toward and away from the respective post 31, a tubular end 51 opposite to the pivot end 52, and a clamp portion 55 extending between the pivot end 52 and the tubular end 51 and formed with an arcuate recess 54 for receiving fittingly an arcuate friction member 60. A protrusion 542 projects from an inner face of the clamp portion 55 into the recess 54 to abut against the friction member 60 so as to reduce contact area between the clamp portion 55 and the friction member 60. The clamp portion 55 of each clamp member 50 is received in the slot 411 in the respective sleeve 41 for abutting against the respective post 31 via the friction member 60 when the clamp member 50 is turned toward the respective post 31.

Each linkage member 70, which is preferably a rod in this embodiment, extends between two adjacent ones of the clamp members 50, and has a flat front end 73 and a rear end 71 that extends through and that is secured to the tubular end 51 of one of the two adjacent clamp members 50 so as to actuate the latter to turn about the respective pivot bolt 53 when the linkage member 70 is actuated to move forwardly and rearwardly.

Each actuating member 80 has a grooved end 85, and a pivot end 81 that is opposite to the grooved end 85 and that has a cam face 811 and a slit 82 extending inwardly from the cam face 811 toward the grooved end 85. The pivot end 81 of each actuating member 80 is pivoted on the front end 73 of the respective linkage member 70, which extends into the slit 82, via a pivot pin 84 passing through the pivot end 81 and the front end 73 for turning about the pivot pin 84 upwardly and downwardly relative to the respective linkage member 70, and for actuating the respective linkage member 70 to move forwardly and rearwardly.

Each engaging member 74, which is preferably an annular plate, is sleeved around the respective linkage member 70 between the respective actuating member 80 and the other one of the two adjacent clamp members 50, and has a front face abutting against the cam face 811 of the pivot end 81 of the respective actuating member 80, and a rear face abutting against the tubular end 51 of the other one of the two adjacent clamp members 50 so that the latter can be actuated by the respective actuating member 80 via the respective engaging member 74 to turn about the respective pivot bolt 53.

The handle 90 has two opposite ends respectively received in and secured to the grooved ends 85 of the actuating members 80 for enabling the actuating members 80 to turn simultaneously about their respective pivot pins 84.

The cam face 811 of the pivot end 81 of each actuating member 80 is eccentric relative to a center of rotation of the actuating member 80 defined by the pivot pin 84 so as to actuate the respective engaging member 74 and the respective linkage member 70 in a cam action manner.

Figure 8:
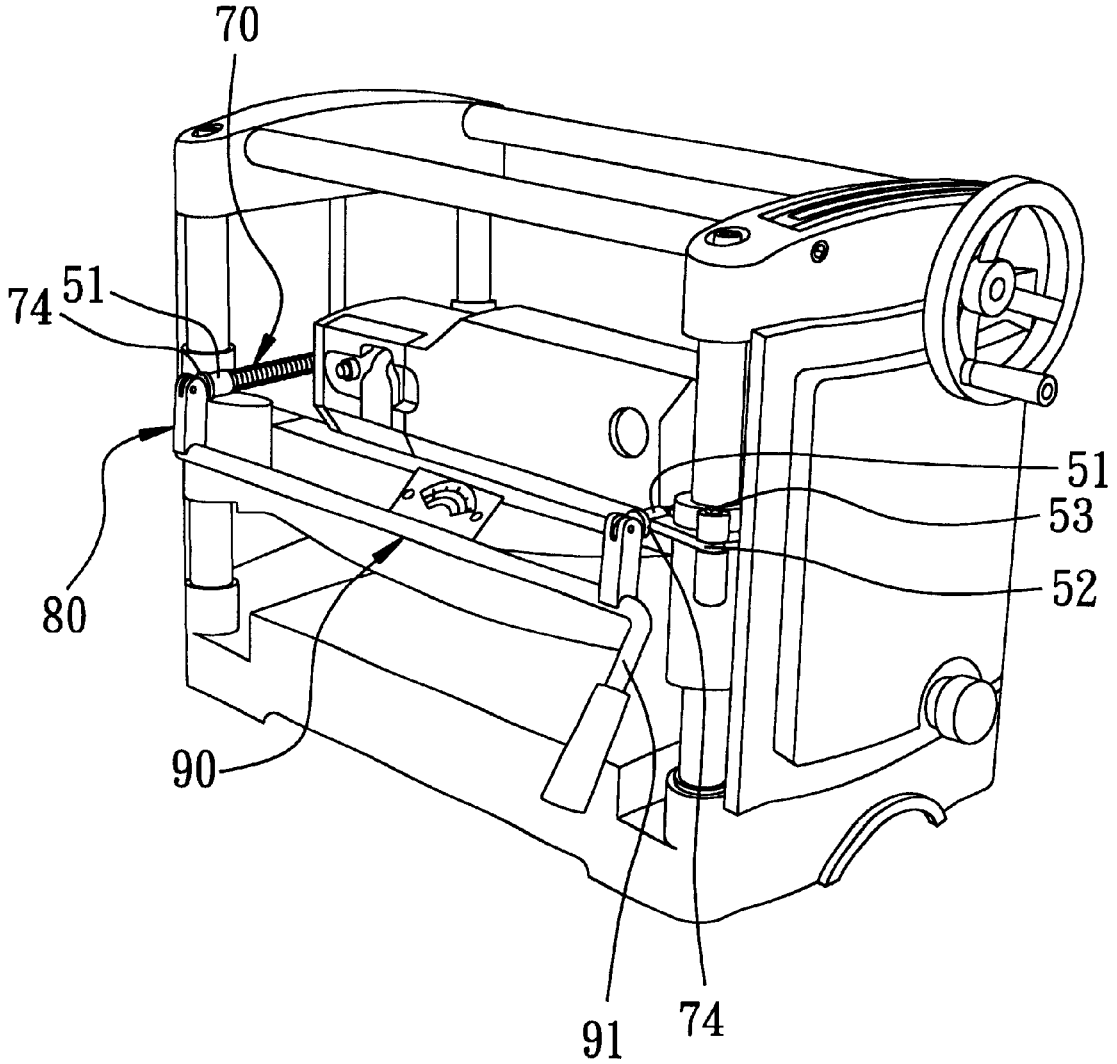
FIG. 8 is a perspective view of the wood planing machine of FIG. 4 in the clamped position.
Figure 9:
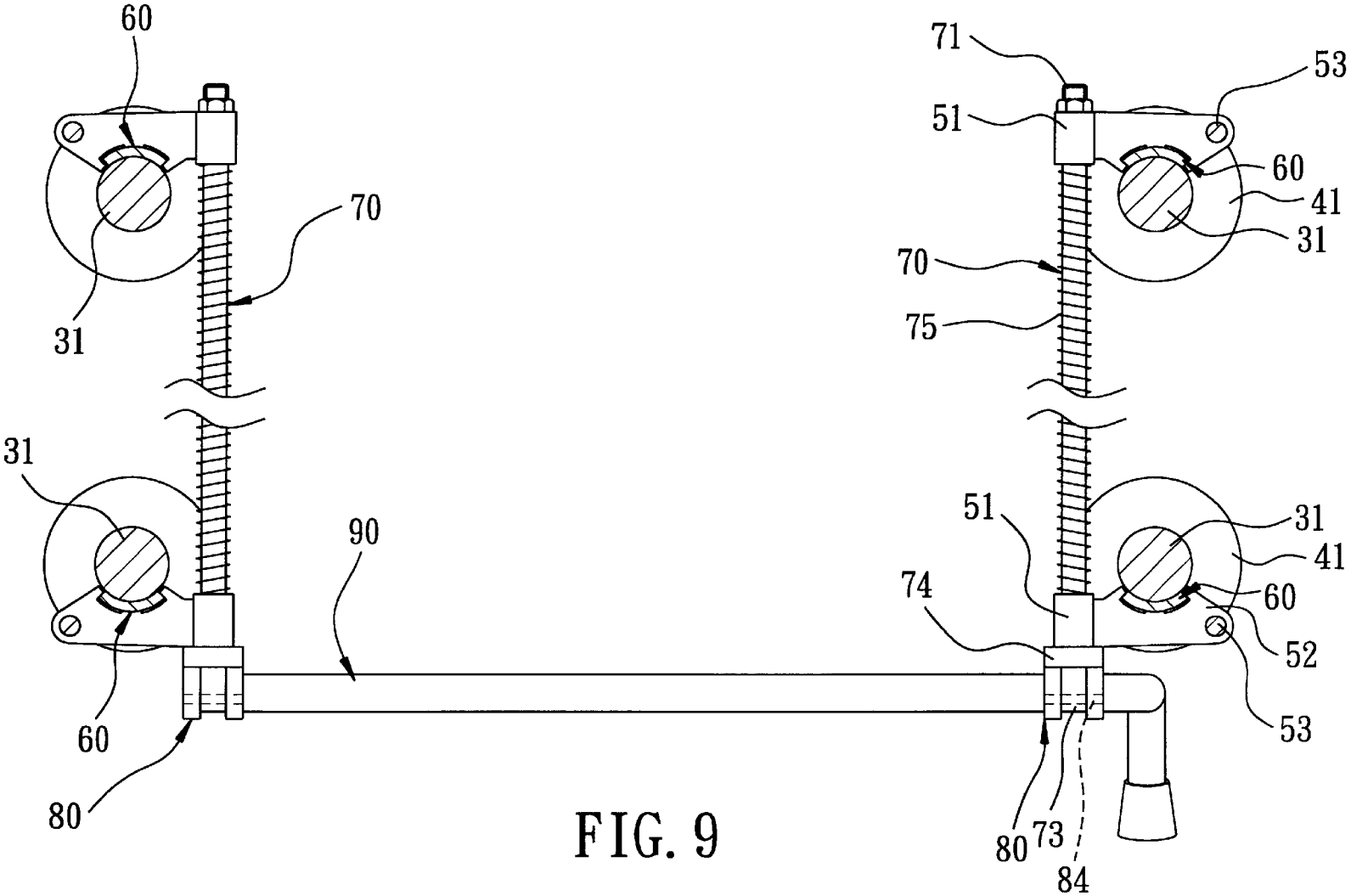
FIG. 9 is a fragmentary cross-sectional top view of the carriage locking unit of the wood planing machine of FIG. 4 in the clamped position.

Each actuating member 80 is turnable about the respective pivot pin 84 between a clamped position (see FIGS. 8 and 9), in which the respective two adjacent ones of the clamp members 50 are respectively pushed by the rear end 71 of the respective linkage member 70 and the respective engaging member 74, thereby providing a clamping force onto the post 31 and thus preventing the vertical translation of the cutter carriage 40, and a release position (see FIGS. 4 and 7), in which the respective two adjacent ones of the clamp members 50 are released from the rear end 71 of the respective linkage member 70 and the respective engaging member 74 to turn away from the respective post 31, thereby permitting the vertical translation of the cutter carriage 40. When operating in the clamped position, each actuating member 80 is preferably turned to a position such that the aforesaid clamping force will result in a counter force acting on the cam face 811 along a line (Y) that passes through the center of rotation of the respective actuating member 80.

An urging member 75, which is preferably a coiled spring, is sleeved around each of the linkage members 70, and has two opposite ends respectively abutting against and urging apart two adjacent ones of the clamp members 50 so as to facilitate operation of the handle 90.

With the carriage locking unit of this invention, the complexity and the problems due to the fatigue of the coiled spring 223 as encountered in the prior art can be eliminated.

With the invention thus explained, it is apparent that various modifications and variations can be made without departing from the spirit of the present invention. It is therefore intended that the invention be limited only as recited in the appended claims.

I claim:

1. A wood planing machine comprising:

a base having a plurality of spaced apart posts that extend upright therefrom;

a cutter carriage mounted movably on said posts; and a carriage locking unit including a plurality of clamp members pivoted on said cutter carriage and turnable respectively toward said posts, a plurality of linkage members, each of which extends between two adjacent ones of said clamp members, and each of which has a front end and a rear end that engages one of two adjacent ones of said clamp members, and a plurality of actuating members, each of which has a pivot end pivoted on said front end of one of said linkage members for turning relative thereto, said pivot end having a cam face that is eccentric relative to a center of rotation of said actuating member, and engaging the other one of said two adjacent ones of said clamp members in a cam action manner, each of said actuating members being turnable relative to the respective one of said linkage members between a clamped position, in which the two adjacent ones of said clamp members are respectively pushed by said rear end of the respective one of said linkage members and the respective one of said actuating members, thereby providing a clamping force onto said posts and thus preventing movement of said cutter carriage along said posts, and a release position, in which the two adjacent ones of said clamp members are released from said rear end of the respective one of said linkage members and the respective one of said actuating members to turn away from said posts, thereby permitting the movement of said cutter carriage along said posts.

2. The wood planing machine of claim 1, wherein the clamping force results in a counter force acting on said cam face along a line that passes through a center of rotation of the respective one of said actuating members.

3. The wood planing machine of claim 1, wherein said cutter carriage includes a plurality of sleeves respectively sleeved around said posts and having slots that respectively extend inwardly to said posts, each of said clamp members having a pivot end pivoted on one of said sleeves, and a clamp portion received in said slot in the respective one of said sleeves and abutting against the respective one of said posts when the respective one of said actuating members is in said clamped position.

4. The wood planing machine of claim 3, wherein said clamp portion of each of said clamp member has a recess, each of said clamp members further having a friction member received fittingly in said recess for abutting against the respective one of said posts when the respective one of said actuating members is in said clamped position.

5. The wood planing machine of claim 4, wherein each of said clamp members further has a tubular end opposite to said pivot end of said clamp member, said rear end of each of said linkage members extending through and being secured to said tubular end of said one of said two adjacent ones of said clamp members, said front end of each of said linkage members extending through said tubular end of the other one of said two adjacent ones of said clamp members.

6. The wood planing machine of claim 1, further comprising a plurality of engaging member, each of which is sleeved around one of said linkage members between an adjacent one of said actuating members and the other one of said two adjacent ones of said clamp members, and each of which has a front face that abuts against said cam face of said pivot end of the adjacent one of said actuating members, and a rear face that abuts against the other one of said two adjacent ones of said clamp members.

7. The wood planing machine of claim 5, further comprising a plurality of engaging members, each of which is sleeved around said linkage member between an adjacent one of said actuating members and the other one of said two adjacent ones of said clamp members, and each of which has a front face that abuts against said cam face of said pivot end of the adjacent one of said actuating members, and a rear face that abuts against said tubular end of the other one of said two adjacent ones of said clamp members.

8. The wood planing machine of claim 7, wherein said pivot end of each of said actuating members has a slit extending inwardly from said cam face, said front end of each of said linkage members extending through the respective one of said engaging members and into said slit to permit said actuating member to turn upwardly and downwardly relative to the respective one of said linkage members.

9. The wood planing machine of claim 8, further comprising an urging member sleeved around each of said linkage members and having two opposite ends respectively abutting against and urging said two adjacent ones of said clamp members.

10. The wood planing machine of claim 9, wherein said urging member is a coiled spring.

11. The wood planing machine of claim 10, further comprising a handle interconnecting said actuating members.

* * * * *